US011037716B2

(12) United States Patent
Lee

(10) Patent No.: US 11,037,716 B2
(45) Date of Patent: Jun. 15, 2021

(54) INDUCTOR AND METHOD OF MANUFACTURING THE SAME

(71) Applicant: SAMSUNG ELECTRO-MECHANICS CO., LTD., Suwon-Si (KR)

(72) Inventor: Sang Jae Lee, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 301 days.

(21) Appl. No.: 16/012,106

(22) Filed: Jun. 19, 2018

(65) Prior Publication Data

US 2019/0198216 A1 Jun. 27, 2019

(30) Foreign Application Priority Data

Dec. 26, 2017 (KR) ..... 10-2017-0179516

(51) Int. Cl.

| | |
|---|---|
| ***H01F 27/24*** | (2006.01) |
| ***H01F 17/00*** | (2006.01) |
| ***H01F 41/04*** | (2006.01) |
| ***H01F 27/32*** | (2006.01) |

(Continued)

(52) U.S. Cl.

CPC ..... *H01F 17/0013* (2013.01); *H01F 17/04* (2013.01); *H01F 27/24* (2013.01); *H01F 27/292* (2013.01); *H01F 27/324* (2013.01); *H01F 41/046* (2013.01); *H01F 2017/0066* (2013.01);

(Continued)

(58) Field of Classification Search

CPC .. H01F 17/0013; H01F 27/292; H01F 41/046; H01F 27/24; H01F 27/324; H01F 17/04; H01F 2017/0066; H01F 2017/0073; H01F 2017/048; H01F 27/303; H01F 27/323

See application file for complete search history.

(56) References Cited

U.S. PATENT DOCUMENTS

| | | | |
|---|---|---|---|
| 2003/0213615 | A1 | 11/2003 | Utsumi et al. |
| 2013/0038417 | A1 | 2/2013 | Kim et al. |
| 2014/0285305 | A1 | 9/2014 | Yoo et al. |

(Continued)

FOREIGN PATENT DOCUMENTS

| | | | |
|---|---|---|---|
| CN | 1461183 | A | 12/2003 |
| CN | 104078221 | A | 10/2014 |

(Continued)

OTHER PUBLICATIONS

Office Action issued in corresponding Korean Application No. 10-2017-0179516, dated Apr. 3, 2019.

(Continued)

*Primary Examiner* — Tuyen T Nguyen

(74) *Attorney, Agent, or Firm* — Morgan, Lewis & Bockius LLP

(57) ABSTRACT

There are provided an inductor and a method of manufacturing the same. The inductor includes: a support member; a first coil pattern formed on one surface of the support member; and a second coil pattern formed on the other surface of the support member, wherein a thickness of the support member between the first coil pattern and the second coil pattern is 1/10 or more of a thickness of the first coil pattern and is less than 1/3 of the thickness of the first coil pattern.

6 Claims, 11 Drawing Sheets

(51) Int. Cl.
*H01F 17/04* (2006.01)
*H01F 27/29* (2006.01)

(52) U.S. Cl.
CPC ..... *H01F 2017/0073* (2013.01); *H01F 2017/048* (2013.01)

(56) References Cited

U.S. PATENT DOCUMENTS

| | | | | |
|---|---|---|---|---|
| 2015/0102889 | A1 | 4/2015 | Choi et al. | |
| 2015/0109088 | A1 | 4/2015 | Kim et al. | |
| 2016/0379750 | A1 | 12/2016 | Hamada et al. | |
| 2017/0032885 | A1* | 2/2017 | Lee | H01F 41/046 |
| 2017/0236633 | A1 | 8/2017 | Park et al. | |
| 2017/0345556 | A1 | 11/2017 | Kim et al. | |

FOREIGN PATENT DOCUMENTS

| | | | |
|---|---|---|---|
| CN | 104575935 | A | 4/2015 |
| CN | 104575937 | A | 4/2015 |
| CN | 106663518 | A | 5/2017 |
| CN | 104766693 | B | 9/2017 |
| JP | 2001-203109 | A | 7/2001 |
| JP | 2017-011185 | A | 1/2017 |
| KR | 10-2013-0017598 | A | 2/2013 |
| KR | 10-2015-0080717 | A | 7/2015 |
| KR | 10-2017-0133140 | A | 12/2017 |

OTHER PUBLICATIONS

Office Action issued in corresponding Chinese Patent Application No. 201811233352.6 dated Oct. 29, 2020, with English translation.

* cited by examiner

INDUCTOR AND METHOD OF MANUFACTURING THE SAME

CROSS-REFERENCE TO RELATED APPLICATION(S)

This application claims the benefit of priority to Korean Patent Application No. 10-2017-0179516 filed on Dec. 26, 2017, in the Korean Intellectual Property Office, the disclosure of which is incorporated herein by reference in its entirety.

TECHNICAL FIELD

The present disclosure relates to an inductor and a method of manufacturing the same.

BACKGROUND

In accordance with the development of information technology (IT), apparatuses have been rapidly miniaturized and thinned. Therefore, market demand for small, thin devices has increased. An inductor needs to be implemented at a small thickness while satisfying required characteristics.

SUMMARY

An aspect of the present disclosure may provide an inductor.

An aspect of the present disclosure may also provide a method of manufacturing an inductor.

According to an aspect of the present disclosure, an inductor may include: a support member; a first coil pattern formed on one surface of the support member; and a second coil pattern formed on the other surface of the support member, wherein a thickness of the support member between the first coil pattern and the second coil pattern is 1/10 to 1/3 of the thickness of the first coil pattern.

According to another aspect of the present disclosure, a method of manufacturing an inductor may include: forming a support member by disposing an insulating film on one surface of a delamination substrate; forming a first coil pattern on one surface of the support member; a complementary layer on the one surface of the support member; removing the delamination substrate; and forming a second coil pattern on the other surface of the support member.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
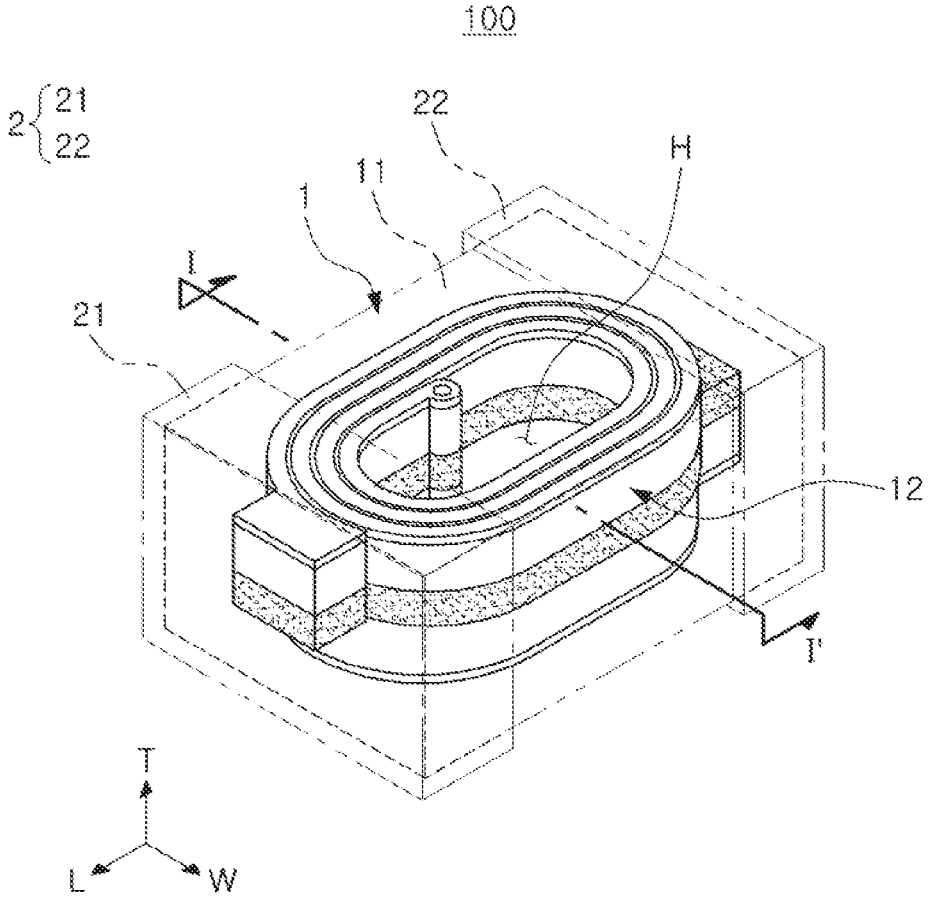
FIG. 1 is a schematic perspective view illustrating an inductor according to an exemplary embodiment in the present disclosure.

Hereinafter, exemplary embodiments of the present disclosure will now be described in detail with reference to the accompanying drawings. In the accompanying drawings, shapes, sizes, and the like, of components may be exaggerated or stylized for clarity.

The present disclosure may, however, be exemplified in many different forms and should not be construed as being limited to the specific embodiments set forth herein. Rather these embodiments are provided so that this disclosure will be thorough and complete, and will fully convey the scope of the disclosure to those skilled in the art.

The term "an exemplary embodiment" used herein does not refer to the same exemplary embodiment, and is provided to emphasize a particular feature or characteristic different from that of another exemplary embodiment. However, exemplary embodiments provided herein are considered to be able to be implemented by being combined in whole or in part one with another. For example, one element described in a particular exemplary embodiment, even if it is not described in another exemplary embodiment, may be understood as a description related to another exemplary embodiment, unless an opposite or contradictory description is provided therein.

The meaning of a "connection" of a component to another component in the description includes an indirect connection through a third component as well as a direct connection between two components. In addition, "electrically connected" means the concept including a physical connection and a physical disconnection. It can be understood that when an element is referred to with "first" and "second", the element is not limited thereby. They may be used only for a purpose of distinguishing the element from the other elements, and may not limit the sequence or importance of the elements. In some cases, a first element may be referred to as a second element without departing from the scope of the claims set forth herein. Similarly, a second element may also be referred to as a first element.

Herein, an upper portion, a lower portion, an upper side, a lower side, an upper surface, a lower surface, and the like, are decided in the accompanying drawings. For example, a first connection member is disposed on a level above a redistribution layer. However, the claims are not limited thereto. In addition, a vertical direction refers to the above-mentioned upward and downward directions, and a horizontal direction refers to a direction perpendicular to the above-mentioned upward and downward directions. In this case, a vertical cross section refers to a case taken along a plane in the vertical direction, and an example thereof may be a cross-sectional view illustrated in the drawings. In addition, a horizontal cross section refers to a case taken along a plane in the horizontal direction, and an example thereof may be a plan view illustrated in the drawings.

Terms used herein are used only in order to describe an exemplary embodiment rather than limiting the present disclosure. In this case, singular forms include plural forms unless interpreted otherwise in context.

FIG. 1 is a schematic perspective view illustrating an inductor according to an exemplary embodiment in the present disclosure. An inductor 100 according to an exemplary embodiment in the present disclosure may include a body 1 and an external electrode 2.

The body 1 may form an exterior of the inductor 100, and have a substantially hexahedral shape including first and second end surfaces opposing each other in a length direction L, first and second side surfaces opposing each other in a width direction W, and upper and lower surfaces opposing each other in a thickness direction T. The body 1 may include a magnetic material 11 and a coil 12.

The magnetic material 11 may be any material having a magnetic property, for example, ferrite or metal magnetic particles filled in a resin, and the metal magnetic particles may include one or more of iron (Fe), silicon (Si), chromium (Cr), aluminum (Al), and nickel (Ni).

The magnetic material 11 may completely encapsulate all portions of the coil 12 except for lead portions of the coil 12 connected to the external electrode 2. Therefore, the magnetic material 11 may serve as a path through which a magnetic flux generated by the coil 12 flows.

The coil 12 may have a generally spiral shape, and include the lead portions connected to the external electrode 2. A detailed configuration of the coil 12 will be described below with reference to FIGS. 2 and 4.

The external electrode 2 may be formed on outer surfaces of the body 1. The external electrodes 2 may include a first external electrode 21 and a second external electrode 22.

When the first external electrode 21 is an input terminal, the second external electrode 22 may be an output terminal. A case in which a cross section of each of the first and second external electrodes 21 and 22 has a 'C' shape is illustrated in FIG. 1, but the cross section of each of the first and second external electrodes 21 and 22 is not limited thereto. That is, the shape of the cross section of each of the first and second external electrodes 21 and 22 may also be changed into an appropriate shape. For example, the shape of the cross section of each of the first and second external electrodes 21 and 22 may be changed into an 'L' shape or may be changed into an 'I' shape so that each of the first and second external electrodes 21 and 22 is disposed on only one surface of the body. The first and second external electrodes 21 and 22 need to include a conductive material, and may include a copper (Cu) pre-plating layer or a silver (Ag)-epoxy composite layer.

Figure 2:
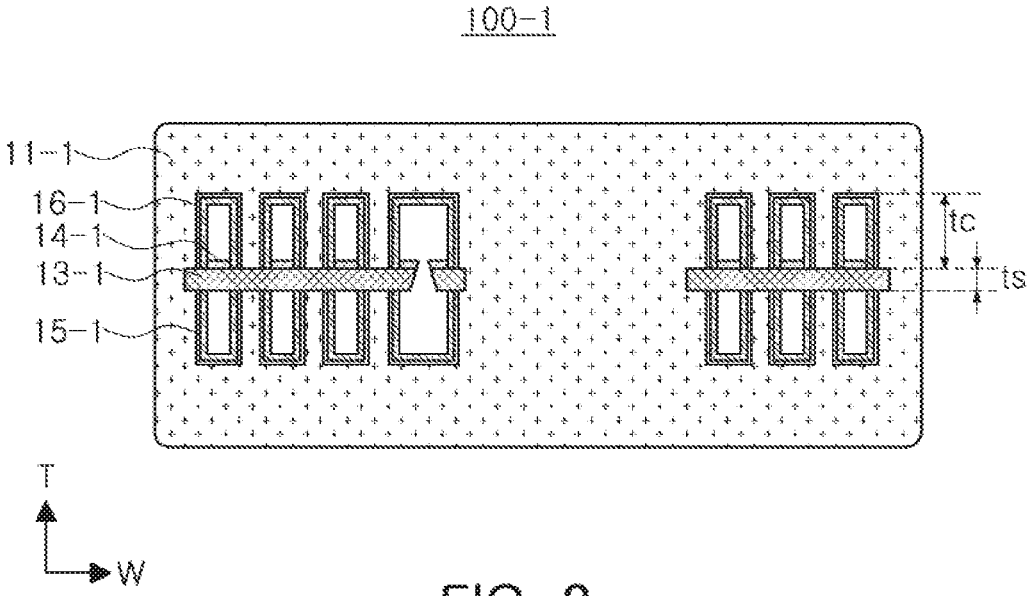
FIG. 2 is a cross-sectional view illustrating the inductor according to an exemplary embodiment in the present disclosure.

FIG. 2 is a cross-sectional view illustrating the inductor according to an exemplary embodiment in the present disclosure, taken along line I-I' of FIG. 1.

A magnetic material 11-1 may be the same as the magnetic material 11 described above with reference to FIG. 1.

The coil 12 (see FIG. 1) may include a support member 13-1, a thin film conductor layer 14-1, a first coil pattern 15-1, and a second coil pattern 16-1.

The support member 13-1 may include a through-hole H (see FIG. 1) formed in a central portion thereof, and a magnetic material may be filled in the through-hole to enhance a magnetic flux generated from the coil 12. The support member 13-1 may include a material having an insulation property and having strength enough to appropriately support the coil pattern, and the like. The support member 13-1 may have a plate shape having a predetermined thickness, but a shape of the support member 13-1 is not limited thereto.

A thickness ts of the support member 13-1 may be about 1/10 to 1/3 of a thickness tc of the coil pattern. That is, the thickness tc of the coil pattern may be in a range from about 60 μm to about 100 μm, and the thickness ts of the support member 13-1 may be in a range from about 10 μm to about 20 μm. A thickness of the first coil pattern 15-1 may be the same as that of the second coil pattern 16-1.

In addition, the support member 13-1 may be an insulating film formed of epoxy. For example, the support member 13-1 may be an insulating film formed of epoxy, such as an Ajinomoto build-up film (ABF), a prepreg (PPG), a photo-imagable dielectric (PID), or the like.

The first coil pattern 15-1 may be disposed on one surface of the support member 13-1 (for example, a lower surface of the support member 13-1), and the second coil pattern 16-1 may be disposed on the other surface of the support member 13-1 (for example, an upper surface of the support member 13-1). The coil pattern 15-1 and the second coil pattern 16-1 may have a spiral shape, and may be connected to each other through a via.

The thin film conductor layer 14-1 may be disposed on the other surface of the support member 13-1 (for example, the upper surface of the support member 13-1). The thin film conductor layer 14-1 may serve as a seed pattern at the time of plating and growing the second coil pattern 16-1. The thin film conductor layer 14-1 may have a generally spiral shape. A case in which the thin film conductor layer 14-1 is disposed on only the other surface of the support member 13-1 (for example, the upper surface of the support member 13-1) is illustrated in FIG. 2, but a thin film conductor layer may also be disposed on one surface of the support member 13-1 (for example, the lower surface of the support member 13-1). The thin film conductor layer disposed on one surface of the support member 13-1 may serve as a seed pattern at the time of plating and growing the first coil pattern 15-1.

FIGS. 3A through 3I are views illustrating a method for manufacturing an inductor according to an exemplary embodiment in the present disclosure.

Figure 3A:
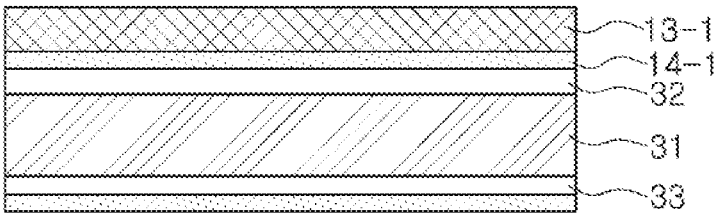
FIGS. 3A through 3I are views illustrating a method for manufacturing an inductor according to an exemplary embodiment in the present disclosure.

First, referring to FIG. 3A, an insulating film that is to serve as the support member 13-1 may be formed on a delamination substrate. As described above, the insulating film may be an insulating film formed of epoxy, such as an ABF, a PPG, a PID, or the like.

Here, the delamination substrate may include a delamination core 31, carrier thin film conductor layers 32 and 33, and a thin film conductor layer 14-1. The delamination substrate has the structure as described above, and a delamination process may thus be more easily performed later. The insulating film may be formed on one surface of the thin film conductor layer 14-1.

A thickness of each of the carrier thin film conductor layers 32 and 33 may be about 1/5 of a thickness of the delamination core 31, a thickness of the thin film conductor layer 14-1 may be about 1/10 of the thickness of each of the carrier thin film conductor layers 32 and 33, and a thickness of the support member 13-1 (that is, the insulating film) may be about 1/10 to about 1/5 of the thickness of the delamination core 31. For example, the thickness of the delamination core 31 may be about 100 μm, the thickness of each of the carrier thin film conductor layers 32 and 33 may be about 18 μm, the thickness of the thin film conductor layer 14-1 may be about 2 μm, and the thickness of the support member 13-1 (that is, the insulating film) may be in a range from about 10 μm to about 20 μm.

Figure 3B:
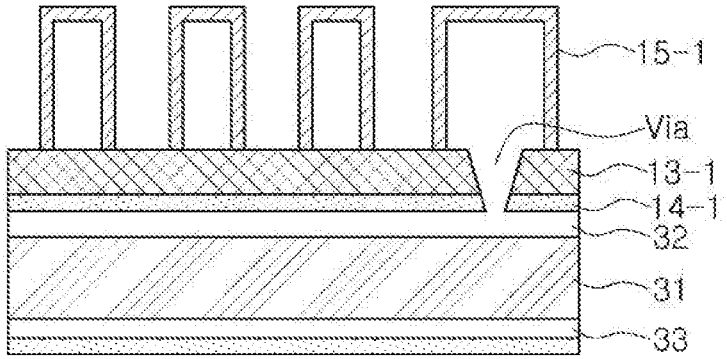

Then, referring to FIG. 3B, the via may be formed in the support member 13-1, and the first coil pattern 15-1 may be formed on one surface of the support member 13-1. Although not illustrated in detail, a first plating layer may be formed by forming a seed layer on the support member 13-1, applying a photosensitive film to the seed layer, performing exposure and development, and then performing a plating process, and a second plating layer may be formed on the first plating layer by removing the remaining photosensitive film and then performing an anisotropic plating process, in order to form the first coil pattern 15-1.

Figure 3C:
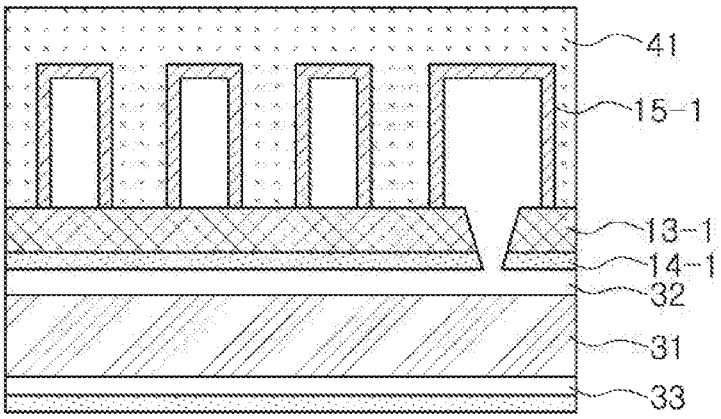

Then, referring to FIG. 3C, a cover layer 41 covering the first coil pattern 15-1 may be formed. Polyethylene terephthalate (PET), a bonding sheet, a foaming tape, or the like, may be used as the cover layer 41.

Figure 3D:
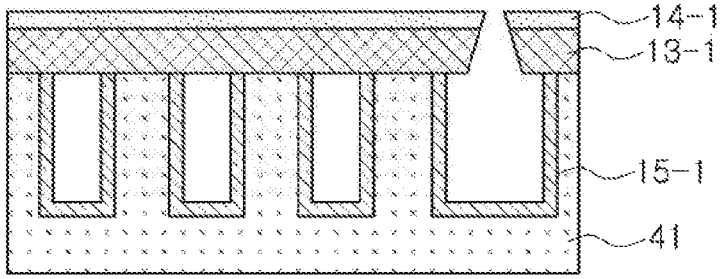

Then, referring to FIG. 3D, the remaining portions of the delamination substrate except for the thin film conductor layer 14-1, that is, the delamination core 31 and the carrier thin film conductor layers 32 and 33 may be delaminated and removed.

That is, according to the exemplary embodiment in the present disclosure, the cover layer 41 may be formed before the delamination substrate is removed. Therefore, even though the support member 13-1 is formed at a sufficiently small thickness if necessary, damage to the support member 13-1 and the first coil pattern 15-1 that may occur when the delamination substrate is removed may be prevented. In other words, according to the exemplary embodiment in the present disclosure, the support member 13-1 may be implemented in a sufficiently small thickness by forming the first coil pattern 15-1 on one surface of the support member 13-1, forming the cover layer 41 on one surface of the support member 13-1, and then removing the delamination substrate.

Figure 3E:
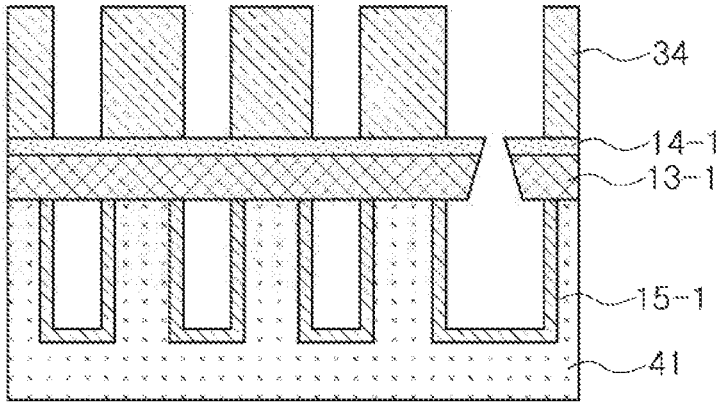

Then, referring to FIG. 3E, a photosensitive film 34 may be formed on the other surface of the support member 13-1, and exposure and development may then be performed.

Figure 3F:
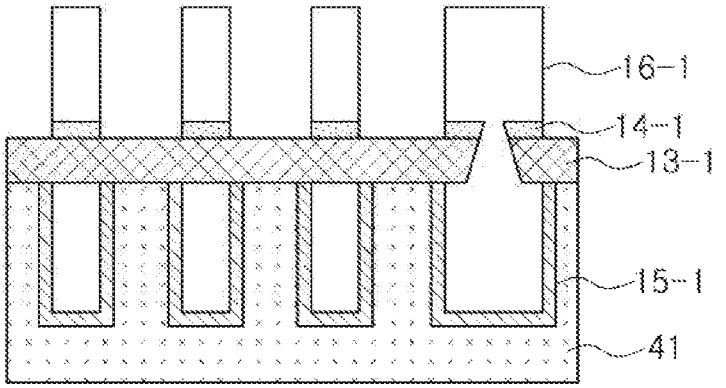

Then, referring to FIG. 3F, a plating process may be performed to form a first plating layer of the second coil pattern 16-1. Then, the remaining photosensitive film may be removed.

Figure 3G:
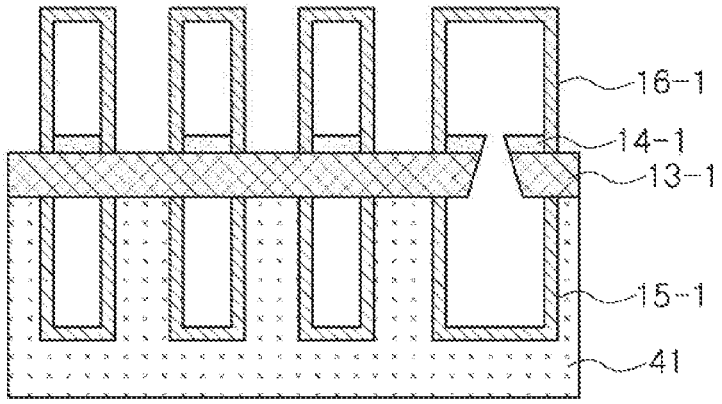

Then, referring to FIG. 3G, an anisotropic plating process may be performed to form a second plating layer of the second coil pattern 16-1. The second plating layer may be formed on an upper surface of the first plating layer.

Figure 3H:
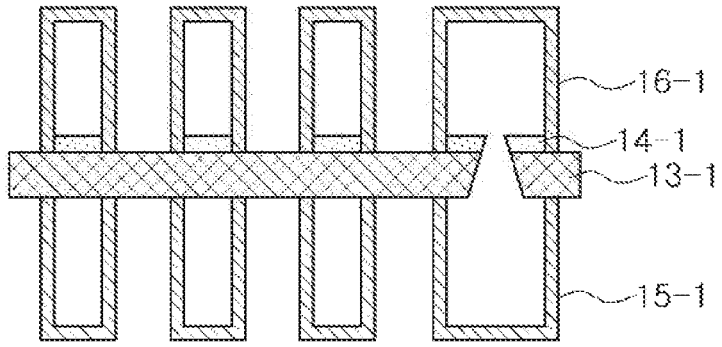

Then, referring to FIG. 3H, the cover layer 41 may be removed.

Figure 3I:
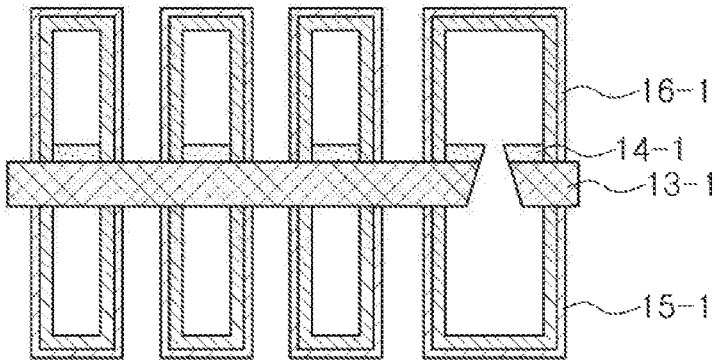

Then, referring FIG. 3I, insulating layers may further be formed on upper surfaces of the first coil pattern 15-1 and the second coil pattern 16-1. The insulating layers may insulate each of the first coil pattern 15-1 and the second coil pattern 16-1 and the magnetic material 11 (see FIG. 1) from each other, and may be formed of a material having an insulation property. The insulating layer may be formed by coating an insulating resin including perylene in a chemical vapor deposition (CVD) manner.

Figure 4:
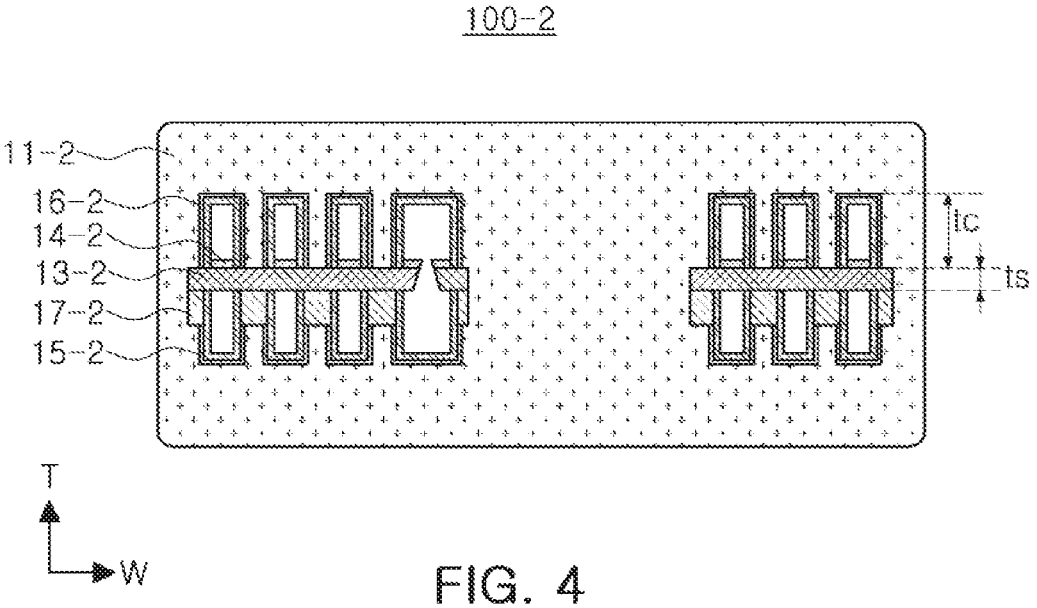
FIG. 4 is a cross-sectional view illustrating an inductor according to another exemplary embodiment in the present disclosure.

FIG. 4 is a cross-sectional view illustrating an inductor according to another exemplary embodiment in the present disclosure, taken along line I-I' of FIG. 1.

A magnetic material 11-2 may be the same as the magnetic material 11 described above with reference to FIG. 1.

In addition, each of a support member 13-2, a thin film conductor layer 14-2, a first coil pattern 15-2, and a second coil pattern 16-2 may be the same as each of the support member 13-1, the thin film conductor layer 14-1, the first coil pattern 15-1, and the second coil pattern 16-1 described above with reference to FIG. 2.

A complementary support member 17-2 may be formed at a thickness lower than that of the first coil pattern 15-2 on one surface of the support member 13-2 (for example, a lower surface of the support member 13-2). The complementary support member 17-2 may be formed of the same material as that of the support member 13-2. That is, the complementary support member 17-2 may be an insulating film formed of epoxy, such as an ABF, a PPG, a PID, or the like.

FIGS. 5A through 5H are views illustrating a method for manufacturing an inductor according to another exemplary embodiment in the present disclosure.

Figure 5A:
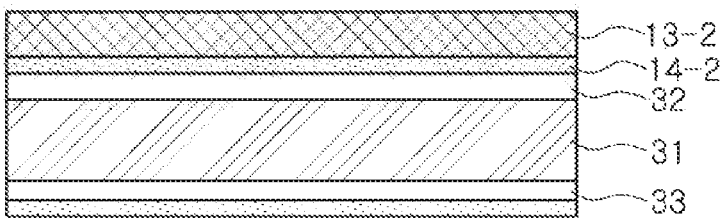
FIGS. 5A through 5H are views illustrating a method for manufacturing an inductor according to another exemplary embodiment in the present disclosure.

First, referring to FIG. 5A, an insulating film that is to serve as the support member 13-2 may be formed on a delamination substrate. As described above, the insulating film may be an insulating film formed of epoxy, such as an ABF, a PPG, a PID, or the like.

Here, the delamination substrate may include a delamination core 31, carrier thin film conductor layers 32 and 33, and a thin film conductor layer 14-2. The insulating film may be formed on one surface of the thin film conductor layer 14-2.

Figure 5B:
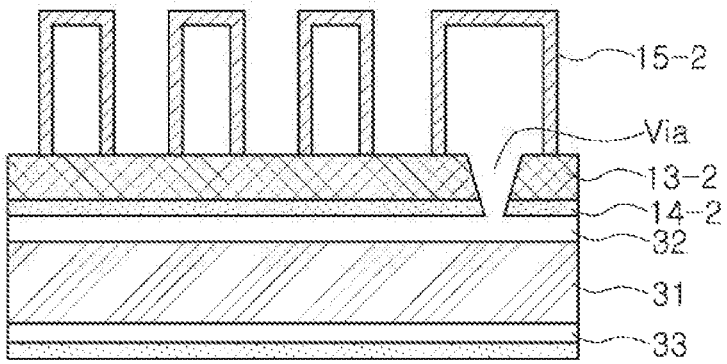

Then, referring to FIG. 5B, a via may be formed in the support member 13-2, and the first coil pattern 15-2 may be formed on one surface of the support member 13-2. Although not illustrated in detail, a first plating layer may be formed by forming a seed layer on the support member 13-2, applying a photosensitive film to the seed layer, performing exposure and development, and then performing a plating process, and a second plating layer may be formed on the first plating layer by removing the remaining photosensitive film and then performing an anisotropic plating process, in order to form the first coil pattern 15-2.

Figure 5C:
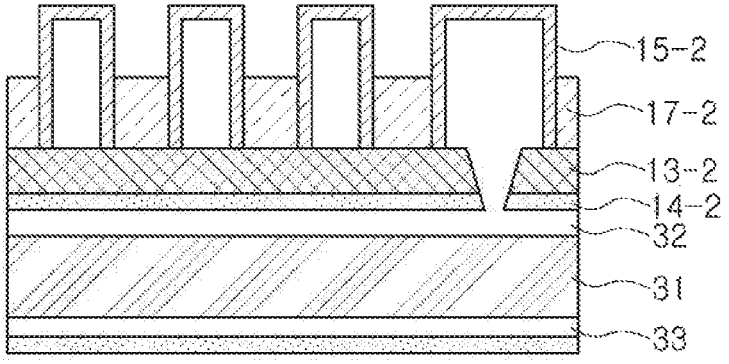

Then, referring to FIG. 5C, the complementary support member 17-2 may be formed at a thickness lower than that of the first coil pattern 15-1. The complementary support member 17-2 may be formed of the same material as that of the support member 13-2.

Figure 5D:
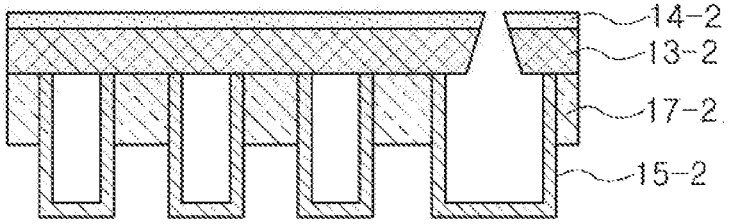

Then, referring to FIG. 5D, the remaining portions of the delamination substrate except for the thin film conductor layer 14-2, that is, the delamination core 31 and the carrier thin film conductor layers 32 and 33 may be delaminated and removed.

That is, according to another exemplary embodiment in the present disclosure, the complementary support member 17-2 may be formed before the delamination substrate is removed. Therefore, even though the support member 13-2 is formed at a sufficiently small thickness if necessary, damage to the support member 13-2 and the first coil pattern 15-2 that may occur when the delamination substrate is removed may be prevented.

Figure 5E:
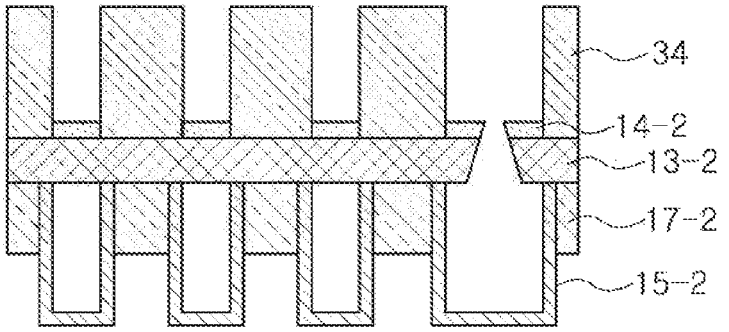
Figure 5F:
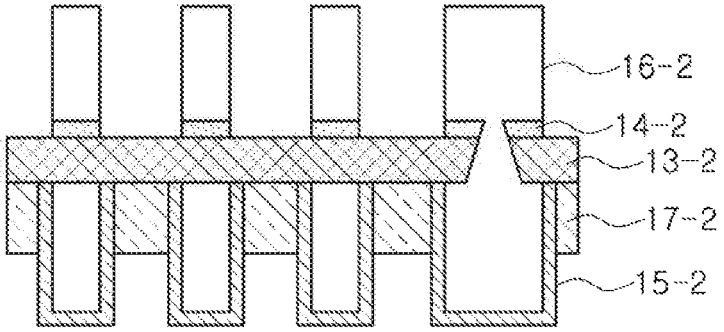
Figure 5G:
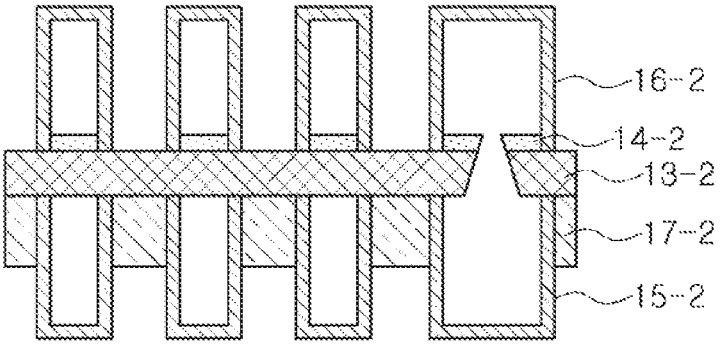

Then, processes illustrated in FIGS. 5E through 5G may be the same as those illustrated in FIGS. 3E through 3G.

Figure 5H:
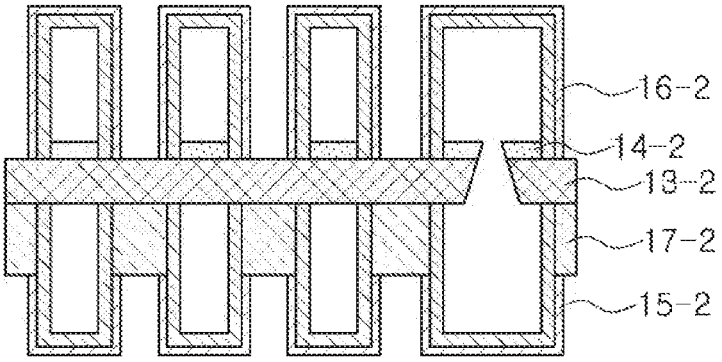

Then, referring FIG. 5H, insulating layers may further be formed on upper surfaces of the first coil pattern 15-2 and the second coil pattern 16-2. The insulating layers may insulate each of the first coil pattern 15-2 and the second coil pattern 16-2 and the magnetic material 11 (see FIG. 1) from each other, and may be formed of a material having an insulation property. The insulating layer may be formed by coating an insulating resin including perylene in a chemical vapor deposition (CVD) manner.

FIGS. 6A through 6K are views illustrating a method for manufacturing an inductor according to another exemplary embodiment in the present disclosure.

Figure 6A:
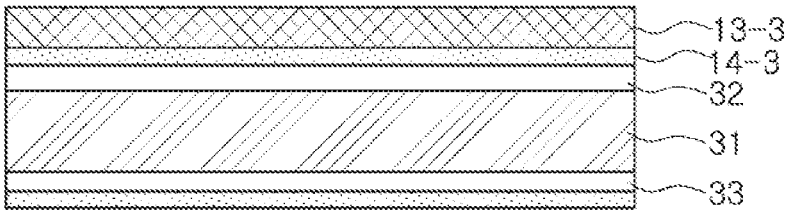
FIGS. 6A through 6K are views illustrating a method for manufacturing an inductor according to another exemplary embodiment in the present disclosure.

First, referring to FIG. 6A, an insulating layer that is to serve as a support member 13-3 may be formed on a delamination substrate. As described above, the insulating layer may be formed of photosensitive epoxy such as a PID, or the like.

Here, the delamination substrate may include a delamination core 31, carrier thin film conductor layers 32 and 33, and a thin film conductor layer 14-3. The insulating film may be formed on one surface of the thin film conductor layer 14-3. A thickness of each of the carrier thin film conductor layers 32 and 33 may be about ⅕ of a thickness of the delamination core 31, and a thickness of the thin film conductor layer 14-3 may be about 1/10 of the thickness of each of the carrier thin film conductor layers 32 and 33. In addition, a thickness of the support member 13-3 (that is, the insulating layer) formed in FIG. 6A may be about 2/5 to about 1/2 of the thickness of the delamination core 31. For example, the thickness of the delamination core 31 may be about 100 μm, the thickness of each of the carrier thin film conductor layers 32 and 33 may be about 18 μm, and the thickness of the thin film conductor layer 14-3 may be about 2 μm. In addition, the thickness of the support member 13-3 (that is, the insulating layer) formed in FIG. 6A may be in a range from about 40 μm to about 50 μm.

Figure 6B:
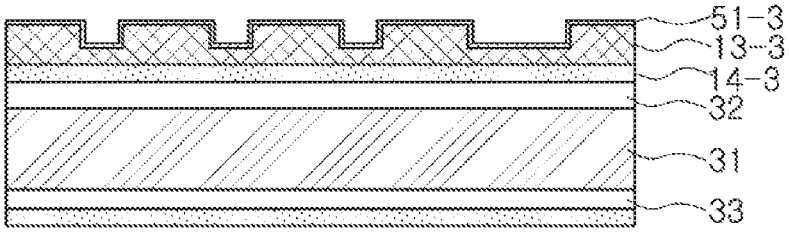

Then, referring to FIG. 6B, exposure and development processes may be performed on the support member 13-3 to pattern a shape of a coil pattern and form a plating layer 51-3 on the support member 13-3. The plating layer 51-3 may be a chemical copper plating layer. In addition, in a process illustrated in FIG. 6B, a thickness of a patterned portion may be in a range from about 10 μm to about 20 μm.

Figure 6C:
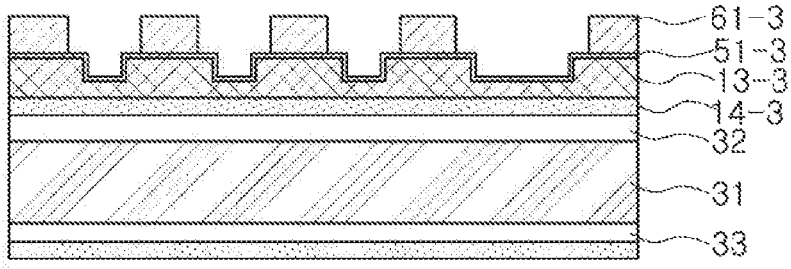

Then, referring to FIG. 6C, a dry film 61-3 may be applied to the plating layer 51-3, and exposure and development may be performed to form a portion in which a coil is to be formed.

Figure 6D:
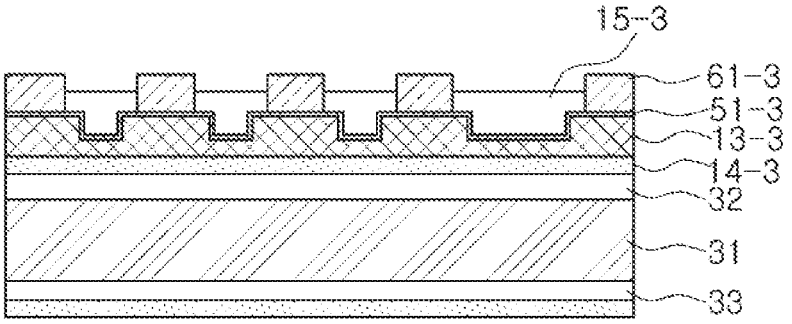

Then, referring to FIG. 6D, a first coil pattern 15-3 may be formed. The first coil pattern 15-3 may be formed by a fill plating process.

Figure 6E:
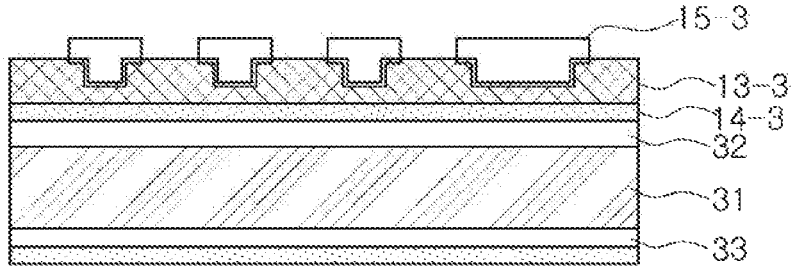

Then, referring to FIG. 6E, the dry film 61-3 of FIG. 6D may be removed by a delamination process, or the like.

Figure 6F:
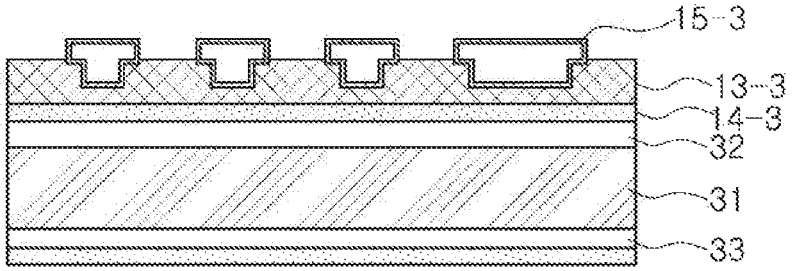

Then, referring to FIG. 6F, an additional plating layer (for example, a lead wire plating layer) may be formed on the first coil pattern 15-3.

Figure 6G:
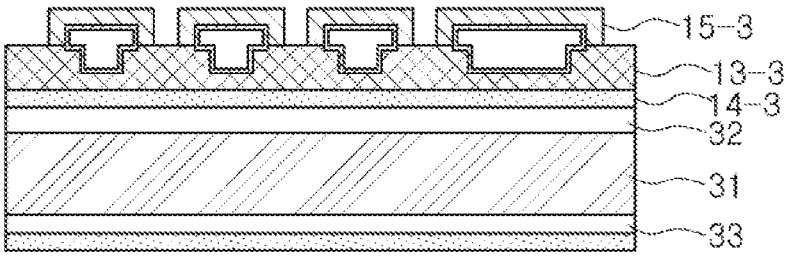

Then, referring to FIG. 6G, an additional plating layer may be formed on the first coil pattern 15-3 by anisotropic plating, or the like.

Figure 6H:
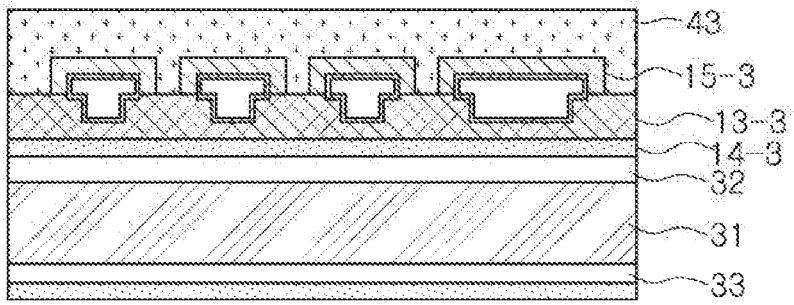

Then, referring to FIG. 6H, a cover layer 43 covering the first coil pattern 15-3 may be formed. PET, a bonding sheet, a foaming tape, or the like, may be used as the cover layer 43.

Figure 6I:
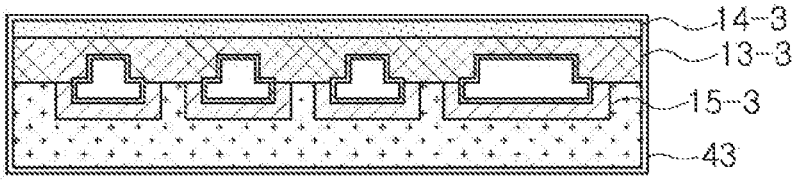

Then, referring to FIG. 6I, the remaining portions of the delamination substrate except for the thin film conductor layer 14-3, that is, the delamination core 31 and the carrier thin film conductor layers 32 and 33 may be delaminated and removed.

Figure 6J:
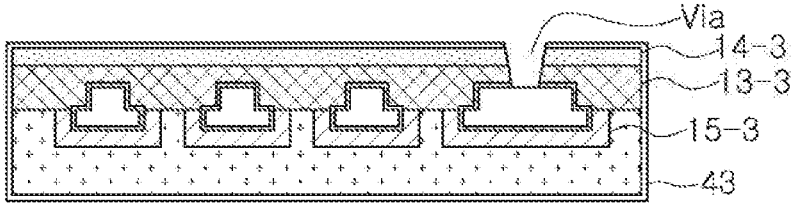

Then, referring to FIG. 6J, a via may be formed in the support member 13-3.

Figure 6K:
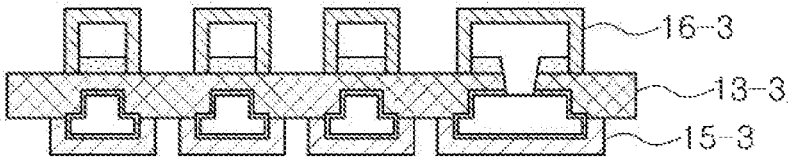

Then, referring to FIG. 6K, a second coil pattern 16-3 may be formed on the other surface of the support member 13-3, and the cover layer 43 may be delaminated. Processes of forming the second coil pattern 16-3 may be the same as those illustrated with reference to FIGS. 3E through 3G. A thickness of the first coil pattern 15-3 (that is, a thickness of a portion in which the support member 13-3 is patterned in the first coil pattern 15-3) and a thickness of the second coil pattern 16-3 may be the same as each other, and may be in a range from about 60 μm to about 100 μm. In addition, a case in which a width of the first coil pattern 15-3 and a width of the second coil pattern 16-3 are different from each other is illustrated in FIG. 6K, and a width of the first coil pattern 15-3 and a width of the second coil pattern 16-3 may be the same as each other.

Although not illustrated in FIGS. 6A through 6K, insulating layers may also be formed on upper surfaces of the first coil pattern 15-3 and the second coil pattern 16-3 as described above with reference to FIG. 3I.

As set forth above, in the inductor and the method of manufacturing the same according to the exemplary embodiments in the present disclosure, a thickness of a core may be sufficiently reduced, such that required characteristics of the inductor may be implemented and the inductor may be thinned.

While exemplary embodiments have been shown and described above, it will be apparent to those skilled in the art that modifications and variations could be made without departing from the scope of the present invention as defined by the appended claims.

What is claimed is:

1. An inductor comprising:

a support member;

a first coil pattern formed on one surface of the support member;

a second coil pattern formed on the other surface of the support member, wherein a thickness of the support member between the first coil pattern and the second coil pattern is 1/10 or more of a thickness of the first coil pattern and is less than 1/3 of the thickness of the first coil pattern; and a complementary support member formed on only the one surface of the support member and disposed between conductor patterns forming the first coil pattern, wherein the support member and the complementary support member comprise insulating materials.

2. The inductor of claim 1, wherein the thickness of the support member between the first coil pattern and the second coil pattern is 10 μm or more and is less than 20 μm.

3. The inductor of claim 1, wherein the support member is an insulating film formed of epoxy.

4. The inductor of claim 1, wherein the complementary support member has a thickness lower than that of the first coil pattern.

5. The inductor of claim 1, wherein the complementary support member is formed of the same material as that of the support member.

6. The inductor of claim 1, further comprising:

a magnetic material in which the support member, the first coil pattern, and the second coil pattern are disposed and which forms an exterior of the inductor; and an external electrode formed on an outer surface of the magnetic material.

* * * * *